US007467424B2

(12) United States Patent
Sokoloff

(10) Patent No.: US 7,467,424 B2
(45) Date of Patent: Dec. 23, 2008

(54) TROUSER GUARD COIL

(76) Inventor: Seth David Sokoloff, 1735 SE. 44th Ave., Portland, OR (US) 97215-3124

( * ) Notice: Subject to any disclaimer, the term of this patent is extended or adjusted under 35 U.S.C. 154(b) by 126 days.

(21) Appl. No.: 11/276,960

(22) Filed: Mar. 18, 2006

(65) Prior Publication Data

US 2007/0214539 A1 Sep. 20, 2007

(51) Int. Cl.
*A41D 1/06* (2006.01)

(52) U.S. Cl. ..... 2/232; 2/60

(58) Field of Classification Search ..... 2/59, 2/60, 232, 311, 338; 24/72.1; 359/516, 519; 63/11; 362/103
See application file for complete search history.

(56) References Cited

U.S. PATENT DOCUMENTS

| | | | | | |
|---|---|---|---|---|---|
| 243,793 | A | * | 7/1881 | Richards | 63/11 |
| 446,819 | A | * | 2/1891 | Ostergren et al. | 24/72.1 |
| 478,772 | A | | 7/1892 | Traut | |
| 503,683 | A | * | 8/1893 | Robertson | 24/72.1 |
| 503,841 | A | * | 8/1893 | Fitler | 24/72.1 |
| 535,400 | A | * | 3/1895 | Rauch | 24/72.1 |
| 562,274 | A | * | 6/1896 | Bowman | 24/72.1 |
| 569,945 | A | * | 10/1896 | Turner | 24/72.1 |
| 579,924 | A | * | 3/1897 | Glasser | 24/72.1 |
| 598,459 | A | * | 2/1898 | Young | 24/72.1 |
| 633,889 | A | * | 9/1899 | Nottingham | 2/232 |
| 870,392 | A | * | 11/1907 | Stearling | 24/72.1 |
| 1,559,165 | A | * | 10/1925 | Hammond | 63/3 |
| 2,123,478 | A | * | 7/1938 | Smith | 359/519 |
| 2,384,255 | A | * | 9/1945 | Moore, Sr. | 24/72.1 |
| 2,396,080 | A | * | 3/1946 | Bruegger | 359/519 |
| 2,462,425 | A | * | 2/1949 | Pratt et al. | 63/3 |
| 3,254,859 | A | * | 6/1966 | Reisch | 242/370 |
| 3,410,023 | A | * | 11/1968 | Anello | 446/353 |
| 4,078,330 | A | * | 3/1978 | Roth | 446/26 |
| 4,724,548 | A | * | 2/1988 | London | 2/338 |
| 4,965,902 | A | * | 10/1990 | Mazzoli | 8/150 |
| 5,169,702 | A | | 12/1992 | Schell | |
| 5,193,026 | A | * | 3/1993 | Purvis et al. | 359/516 |
| 5,738,398 | A | * | 4/1998 | Miano | 294/1.1 |
| 5,857,217 | A | * | 1/1999 | Hsueh | 2/170 |
| 6,397,854 | B1 | * | 6/2002 | Bailey | 132/200 |
| 6,554,684 | B2 | * | 4/2003 | Marlin | 446/486 |
| 6,712,286 | B2 | * | 3/2004 | Baxter et al. | 239/36 |
| 7,121,475 | B2 | * | 10/2006 | Thomas | 239/53 |
| 7,383,588 | B2 | * | 6/2008 | Victor | 2/16 |
| 2002/0181104 | A1 | * | 12/2002 | Gonzales | 359/517 |
| 2004/0042200 | A1 | * | 3/2004 | Hurwitz | 362/84 |
| 2006/0185059 | A1 | * | 8/2006 | Taha et al. | 2/170 |

* cited by examiner

*Primary Examiner*—Alissa L Hoey

(57) ABSTRACT

A Trouser Guard Coil (99) is a watch spring shape strip (100) of springable material used to bind objects together. The Trouser Guard Coil has a first end (101), a second end (102), a top edge (103), and a bottom edge (104). Top and bottom edges (103 and 104), are parallel volute coils that extend from the first end (101) to the second end (102). The strip (100) has a front surface (105) on the exterior side of the coil, and a rear surface (106) on the interior side. The Trouser Guard Coil is employed by simultaneously uncoiling the strip (100) from the volute form and recoiling it in a helical manner to bring the rear surface (106) into contact with a mounting surface (107), such as a trouser leg worn by a user. In a preferred embodiment, the front surface (105) is highly reflective of optical light, and the strip (100) has a cushion material (109) to aid comfort and positional stability.

3 Claims, 4 Drawing Sheets

TROUSER GUARD COIL

BACKGROUND

1. Field of Invention

The present invention relates generally to volute coil spring devices, specifically one which functions as a Trouser Guard.

2. Discussion of Prior Art

It is known to provide trouser guard devices in order to bind the trousers of a user close to the leg of the user. These devices, as in U.S. Pat. No. 446,819 to Ostergren (1891), have long been used by bicyclists to prevent their trousers from being soiled by, or caught in, the bicycle transmission. Such devices often provide an optically reflective area in order to increase the visibility of the user in low light situations, such as at night and during twilight times, as in U.S. Pat. No. 2,396,080 to Bruegger (1946). Currently the most popular style of trouser guard is a reflective wrap that fastens with a hook and loop closure, as in U.S. Pat. No. 5,169,702 to Schell (1992). In general, these styles provide a limited area of binding along the leg of the user, often necessitating careful gathering of the trousers prior to binding, or providing inadequate binding. These styles can provide a wide angular range of reflectivity, although the reflective area is generally small. A larger reflective area would provide a viewer with an image that can be more easily seen. These styles are often limited in the range of sizes that can be accommodated, requiring various sizes to fit different people. The popular reflective wrap type devices often fall off of the user unnoticed, and are commonly lost, causing a loss of all functions, and necessitating frequent replacement. In summary, known prior art has an inadequate amount of binding and reflective area, is easily lost, and often fits only a narrow range of object sizes.

SUMMARY OF THE INVENTION

In accordance with the present invention a Trouser Guard Coil is a springable strip in the shape of volute, flat, or watch spring, coil that is employed by simultaneously uncoiling the trouser guard from the volute form and recoiling, or wrapping, it around a mounting surface in a preferably helical manner.

OBJECTS AND ADVANTAGES

Accordingly several objects and advantages of the present invention are: to provide a Trouser Guard Coil that binds clothing close to the body to prevent said clothing from being tangled in, or dirtied by, gears or machinery, and various other purposes;

- to provide a Trouser Guard Coil with a reflective surface that is visible from a wide range of angles,
- to provide a Trouser Guard Coil that provides significantly greater binding area than commonly known trouser guards,
- to provide a Trouser Guard Coil that provides significantly greater reflective area than commonly known trouser guards,
- to provide a Trouser Guard Coil with a reflective surface that conforms to the shape of the mounting surface to aid in viewer recognition of the object,
- to provide a Trouser Guard Coil that is unlikely to fall off during use,
- to provide a Trouser Guard Coil that is conveniently stored after use,
- to provide a Trouser Guard Coil that is inexpensive to manufacture.

OTHER OBJECTS AND ADVANTAGES

The Trouser Guard Coil can be used without a garment, for reflective properties. Such use may be on an arm or leg of a user, or on any objects which require additional temporary, or permanent, nighttime or twilight visibility. A baby stroller, poles, packages, and work equipment are examples of this type of use.

The constrictive property of the Trouser Guard Coil has many other uses; such as to secure a tarp around an object, or to bind together multiple objects.

Further objects and advantages of the invention will become apparent from a consideration of the drawings and ensuing descriptions.

DESCRIPTION OF INVENTION

Figure 1:
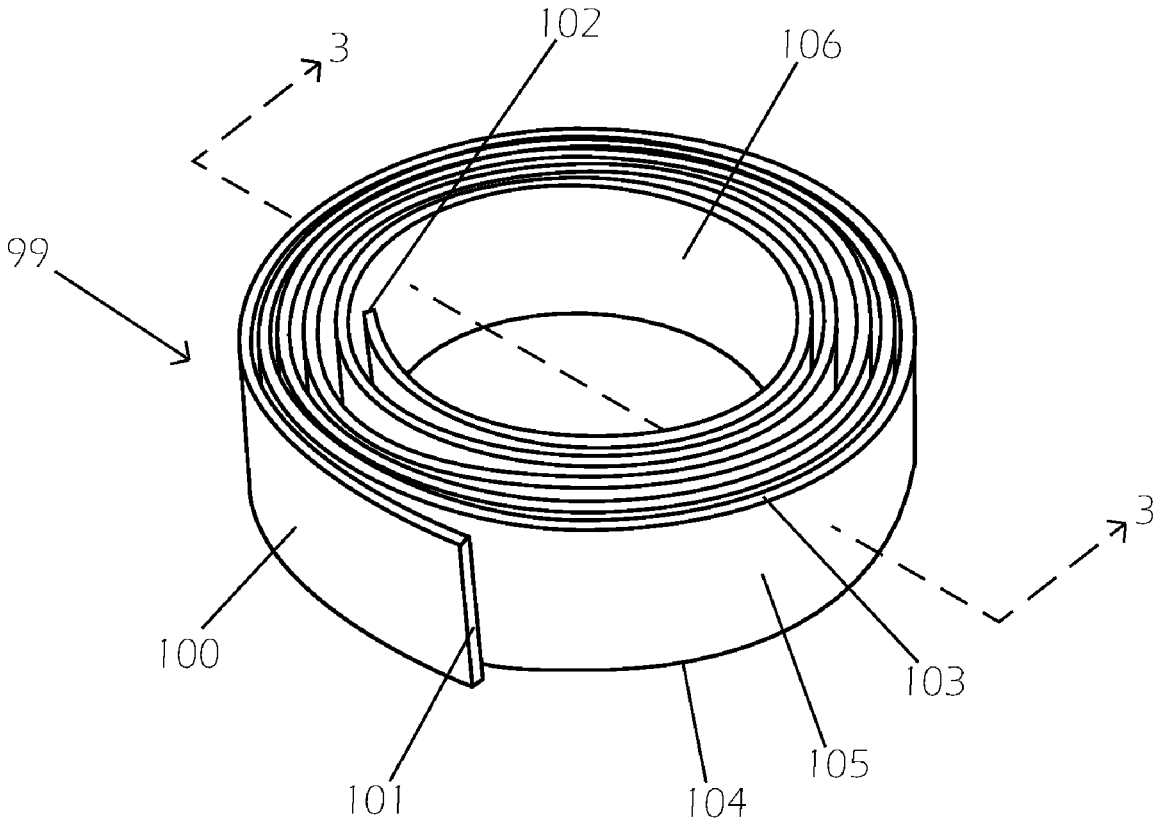
FIG. 1 is a perspective view of the Trouser Guard Coil in storage alignment.
Figure 2:
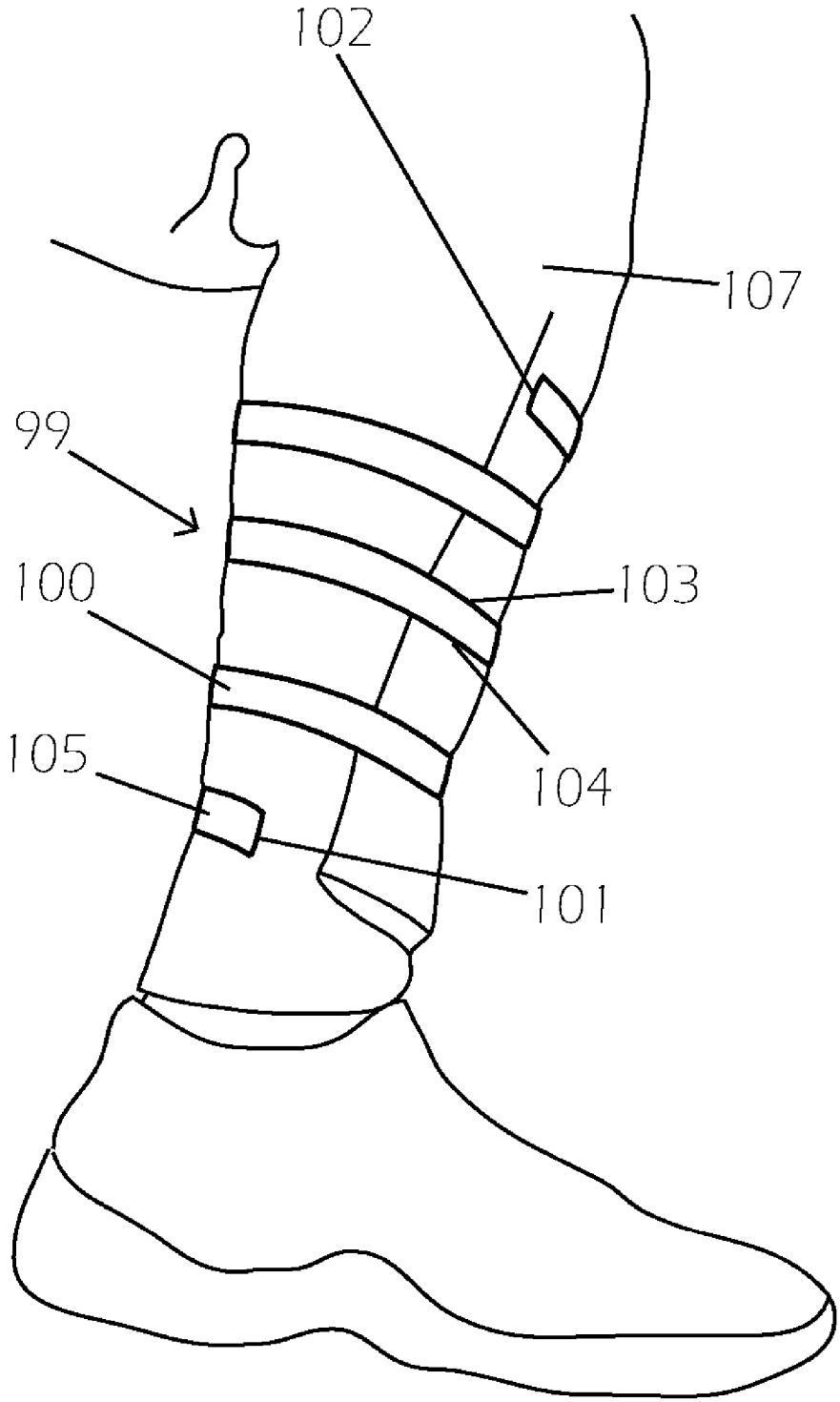
FIG. 2 is a perspective view of the Trouser Guard Coil in use.
Figure 3:
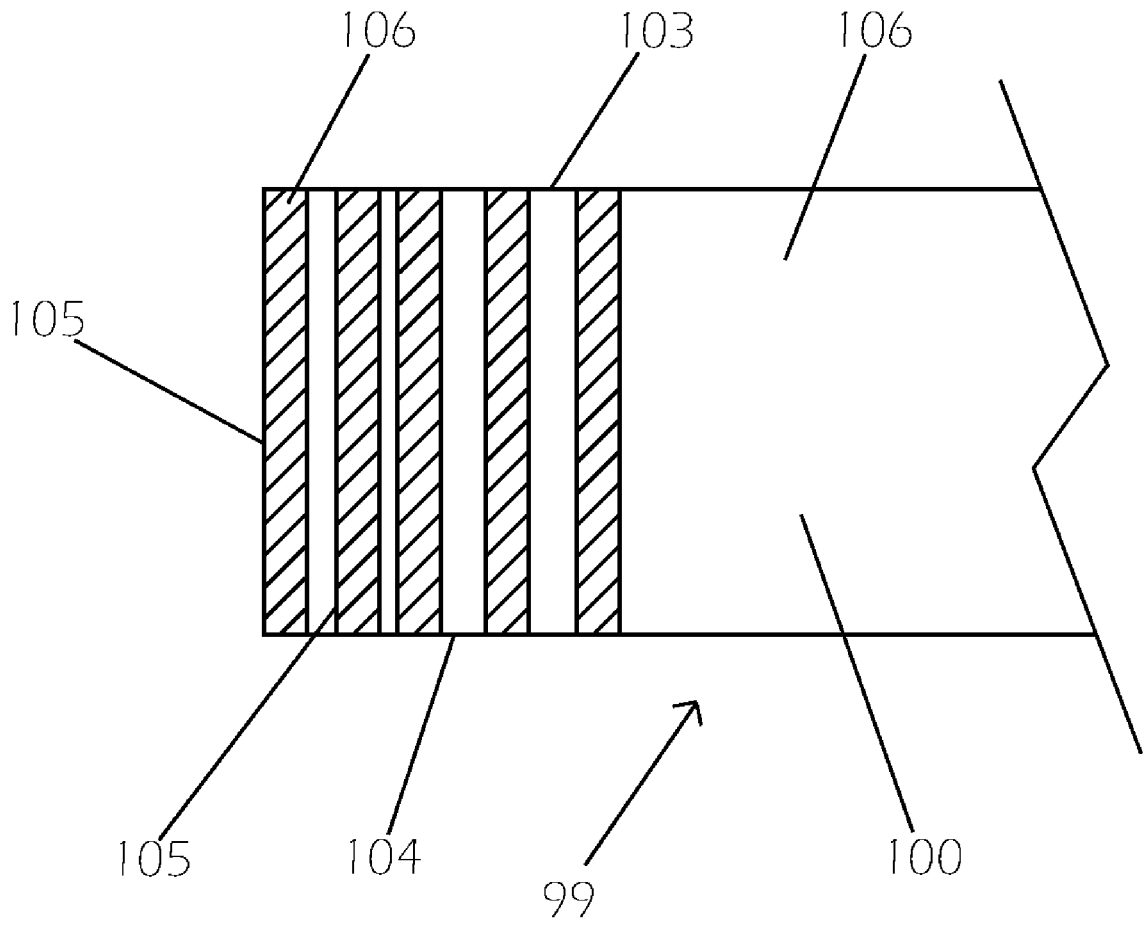
FIG. 3 is a partial sectional view of the Trouser Guard Coil, indicated by line 3-3 in FIG. 1.

FIGS. 1, 2, and 3

FIG. 1 is a perspective view of the Trouser Guard Coil 99 in storage alignment. The Trouser Guard Coil 99 is a strip 100 of springable material in the shape of a volute coil, or watch spring. In storage alignment, strip 100 is in the most relaxed position. The springable material may be any of many commonly known materials, having the appropriate balance of resiliency and pliability, such as Polyethylene Terepthalate Glycol plastic (PETG). Strip 100 has a first end 101, a second end 102, a top edge 103, and a bottom edge 104. Top and bottom edges, 103 and 104, are parallel volute coils, extending between first and second ends, 101 and 102. Strip 100 has a front surface 105, and a rear surface 106. Front surface 105 is the exterior side of the coil strip. Rear surface 106 is on the interior side of the coil strip.

FIG. 2 is a perspective view of the Trouser Guard Coil 99 in use around a mounting surface 107, a trouser leg worn by a user. In this view, the Trouser Guard Coil 99 is in a helical alignment, strip 100 is deformed perpendicular to the coil axis, and parallel to the coil axis.

The Trouser Guard Coil 99 is a unitary material as depicted in FIG. 3.

DESCRIPTION OF A PREFERRED EMBODIMENT

FIG. 4

Figure 4:
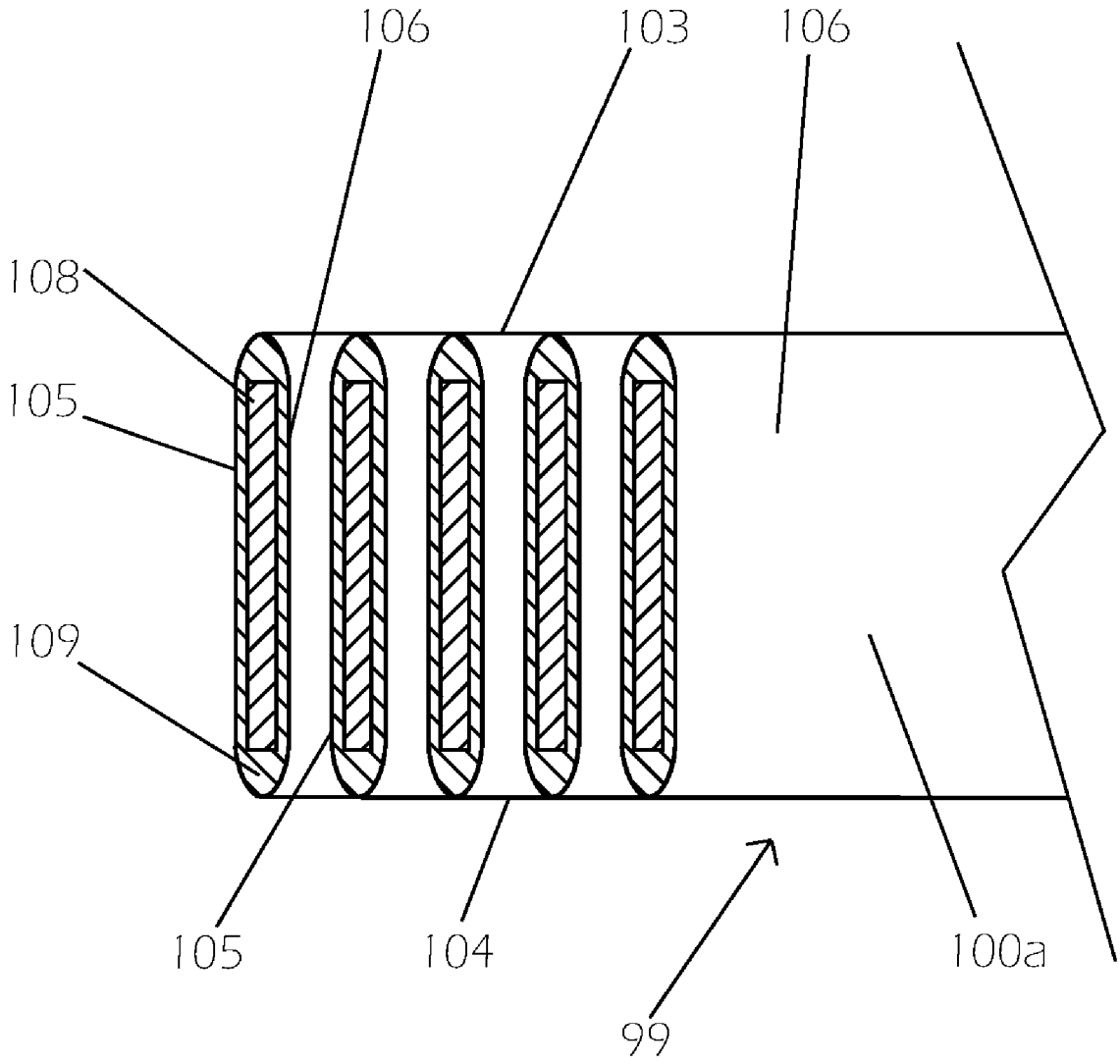
FIG. 4 is a partial sectional view, similar to that of FIG. 3, of a preferred embodiment of the Trouser Guard Coil.

FIG. 4 is a sectional view of a preferred embodiment of the Trouser Guard Coil 99, from a section similar to that in FIG. 3. A multi-layer springable strip 100*a* is a narrow spring 108 encased in a soft flexible material 109. In addition, front surface 105 is highly reflective of optical light.

OPERATION OF INVENTION

FIGS. 1-4

The invention in storage alignment, as in FIG. 1, is compact and may be stored in a pocket, or around an object such as the handle of a baby stroller, or a bicycle frame. For use, rear surface 106 near first end 101 is placed on mounting surface 107, and strip 100 is simultaneously uncoiled from the volute, relaxed position and coiled around mounting surface 107 in a helical manner, as in FIG. 2. On mounting surface 107, the Trouser Guard Coil 99 is held in place by the constrictive property of the deformed coil. In this position, the Trouser Guard Coil 99 provides binding area many times greater than commonly known trouser guards. Approximately 1 and ⅓ revolutions of the Trouser Guard Coil 99 around mounting surface 107 are generally adequate to prevent accidental loss during use.

As depicted in FIG. 4, cushion material 109 surrounds the spring 108 and provides additional comfort and positional stability. Cushion material 109 is attached along the entire coil, or intermittently, or only near first and second ends, 101 and 102. The highly reflective front surface 105 provides reflective area many times greater than commonly known trouser guards.

The Trouser Guard Coil 99 may also be stored in the helical manner, similar to FIG. 2, coiled along the length of an object such as the top tube of a bicycle, serving as a reflector until needed as a trouser guard.

CONCLUSION, RAMIFICATIONS, AND SCOPE

Accordingly, the reader will see that a Trouser Guard Coil is convenient for users in a wide range of situations, and provides superior performance. The Trouser Guard Coil provides reflective and clothes binding area for the length of the coil, a greater area than that of commonly known trouser guards. Recognition and visibility are aided by the larger amount of reflected area as shaped by the mounting surface. Some additional embodiments and features that are considered to fall within the scope of the invention include;

- front surface 105 may be integral, a surface coating, or a fastened material,
- various widths and lengths of strip 100, for a large variety of mounting surfaces 107,
- various textures on rear surface 106 to enhance comfort, and positional stability,
- end caps, or additional materials, for first and second ends, 101 and 102, to enhance comfort, and positional stability,
- joints formed by material gaps, or additional materials, for additional articulation to enhance comfort, positional stability, and enable a greater range of uses,
- an illumination system, such as light emitting diodes, or luminescent materials.

What is claimed is:

1. A method of binding a trouser leg of a user close to the leg of a user, said method comprising the steps of:

a. providing a springable strip in the shape of a volute coil, the strip having a first end, a second end, a top edge, and a bottom edge, said top and bottom edges being parallel volute coils extending lengthwise between said first and second ends, the strip also having a front surface on the exterior side of the coil, and a rear surface on the interior side of the coil, b. pulling said first end away from body of the coil, placing the rear side of the coil on the trouser leg near the ankle of a user with the coil close to perpendicular to the leg, unwinding the volute coil and simultaneously wrapping the coil in a helical manner around the leg toward the calf, wherein said coil provides radial binding force along a width significantly greater than the width of the volute coil, whereby said trouser leg is securely bound over a large area of said leg of user.

2. The method according to claim 1 wherein the front surface is highly reflective of optical light.

3. The method according to claim 1 wherein the strip is comprised of multiple materials.

* * * * *